US011420794B2

(12) United States Patent
Dauer-Whitchurch

(10) Patent No.: US 11,420,794 B2
(45) Date of Patent: Aug. 23, 2022

(54) TRANSPARENT CONTAINER WITH FITTED INSERT

(71) Applicant: Tiffany Dauer-Whitchurch, Capitola, CA (US)

(72) Inventor: Tiffany Dauer-Whitchurch, Capitola, CA (US)

( * ) Notice: Subject to any disclaimer, the term of this patent is extended or adjusted under 35 U.S.C. 154(b) by 0 days.

(21) Appl. No.: 16/449,421

(22) Filed: Jun. 23, 2019

(65) Prior Publication Data

US 2021/0253304 A1 Aug. 19, 2021

Related U.S. Application Data

(60) Provisional application No. 62/688,514, filed on Jun. 22, 2018.

(51) Int. Cl.
*B65D 25/16* (2006.01)

(52) U.S. Cl.
CPC ..... *B65D 25/16* (2013.01)

(58) Field of Classification Search
CPC ..... B65D 25/16; B65D 25/14; B65D 25/10; B65D 69/00; B65D 77/00; B65D 11/20; B65D 1/40; B65D 21/0233; B65D 21/02
USPC ..... 220/665, 662, 528, 23.91, 23.86, 23.83; 206/577, 223, 216, 282; 229/162.1
See application file for complete search history.

(56) References Cited

U.S. PATENT DOCUMENTS 917,066 A * 4/1909 Hine ..... B65D 61/00 206/577
1,673,112 A * 6/1928 Gage, Jr. ..... B65D 5/4204 229/162.1
1,799,788 A * 4/1931 Hermann ..... B65D 5/321 229/125.015
2,046,975 A * 7/1936 Shaw ..... B65D 25/14 428/146
2,054,785 A * 9/1936 Harris ..... B65D 25/54 217/122
2,072,753 A * 3/1937 Ikeda ..... B65D 5/2047 206/45.29
2,077,697 A * 4/1937 Hunt ..... B65D 25/16 426/411
2,429,538 A * 10/1947 Wood ..... B65D 25/16 206/522
2,737,337 A * 3/1956 Moore ..... B65D 5/563 229/212
2,790,589 A * 4/1957 Moore ..... B65D 5/38 229/125.125
2,936,944 A * 5/1960 Moore ..... B65D 5/38 229/125.125
3,756,495 A * 9/1973 Bemiss ..... B65D 5/563 229/5.84
4,047,633 A * 9/1977 Trombly ..... A47J 41/0072 220/592.2
4,195,729 A * 4/1980 Macken ..... A47G 1/14 206/216

(Continued)

*Primary Examiner* — Robert J Hicks
(74) *Attorney, Agent, or Firm* — Soquel Group LLC

(57) ABSTRACT

Embodiments of the subject invention are directed to a transparent container with an insert that maintains its form and position when fit snugly inside of the container. The container and insert material are chosen to take advantage of inherent properties including stiffness, static friction and static cling such that no further fastening material, such as glue, is needed to secure the insert inside the container.

9 Claims, 2 Drawing Sheets

(56) References Cited

U.S. PATENT DOCUMENTS

2006/0289609 A1* 12/2006 Fritz ..... B65D 1/265
229/4.5

* cited by examiner

TRANSPARENT CONTAINER WITH FITTED INSERT

FIELD OF ART

This description generally relates to packaging. The invention is especially to a system and method for providing consumer packaging that includes a clear container and a printed insert.

BACKGROUND OF THIS INVENTION

Packaging of consumer products constitutes a significant fraction of the manufacturing cost. Thus, techniques for reducing the cost of packaging for such product are desirable.

Typically, packaging of relatively small products, e.g. jewelry, includes a container with an exterior printed label or sleeve. The printed elements typically provide information about the product or are decorative. It is desirable to reduce the cost of both the container, the printed elements as well as the labor to manufacture the final packaging.

Typically a container is an opaque material such as thick paper or cardboard with an exterior printed elements. While low cost, transparent plastic containers are available, they are not typically used in consumer packaging. Typical consumer packaging has printed elements visible on the outside of the container rather than visible through a plastic container. In cases consumer packaging employs a transparent plastic external package, internal printed elements are typically secured to the inside of the package. In certain cases, transparent plastic containers are used in packaging such as product packaging, gift wrapping and food packaging with the objective of displaying the internal product or contents.

Thus it would be desirable to provide packaging in the form of a low cost plastic container that enables a printed insert to be visible through plastic sides of the container.

SUMMARY

The subject invention is a transparent container with an insert that maintains its form when fit snugly inside of the container. The container and insert material are chosen to take advantage of inherent properties including stiffness, static friction and static cling such that no further fastening material is needed to secure the insert inside the container.

The subject invention includes a transparent container and a printed insert that fits securely inside the container. The insert is cut and folded so as to fit exactly within the container. The insert typically includes printed elements such as text and graphics that are visible through the container from the outside of the container. Provided that the insert is made of a material of sufficient stiffness, such as paper or cardboard, the insert remains in place within the container and thus eliminates the need for a label or sleeve or other exterior printed elements.

In addition to the stiffness of the insert, static friction and electrostatic cling may be used to hold the insert in place within the package.

BRIEF DESCRIPTION OF DRAWINGS

Non limiting and non exhaustive embodiments of the present invention are described with reference to the following drawings. In the drawings, like reference numerals refer to like parts throughout the various figures unless otherwise specified.

Figure 1B:
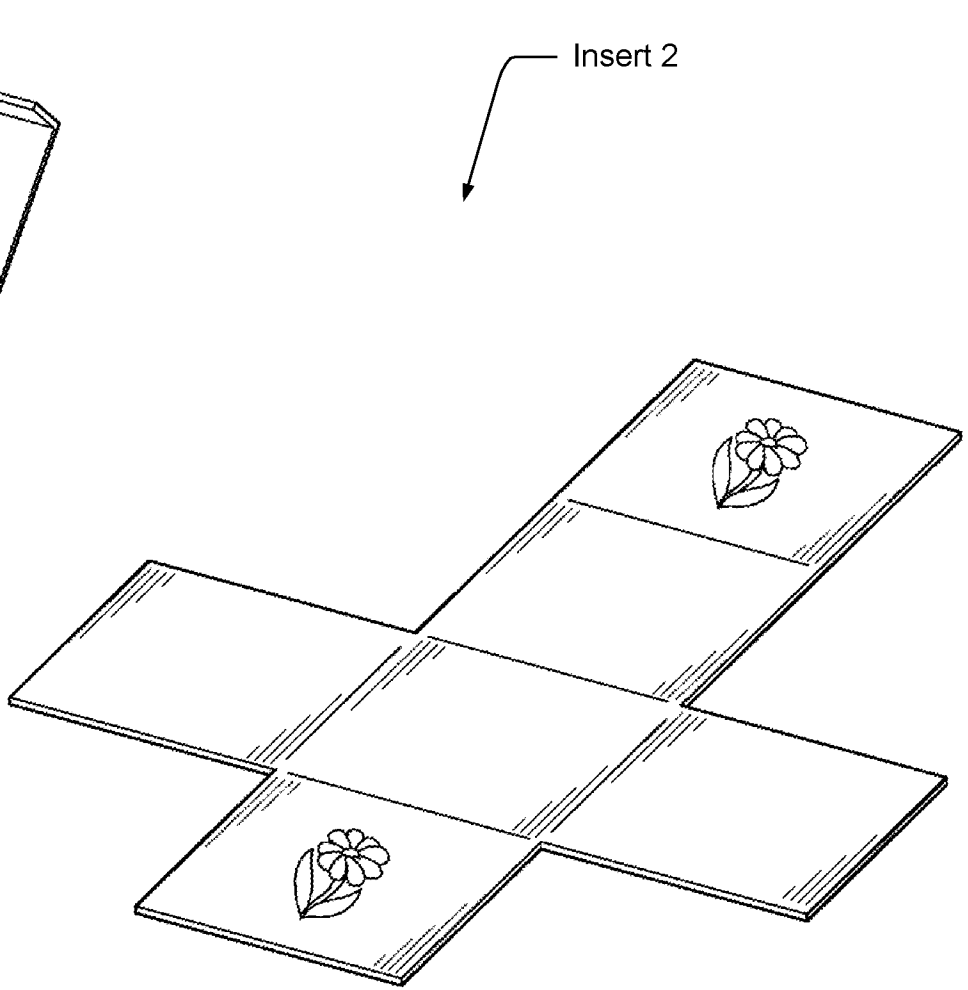
FIG. 1B illustrates a top isometric view of a printed insert that is cut so that it fits snugly within the container of FIG. 1A.

The figures depict embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION

The invention now will be described more fully hereinafter with reference to the accompanying drawings, which form a part hereof, and which show, by way of illustration, specific exemplary embodiments by which the invention may be practiced. This invention may, however, be embodied in many different forms and should not be construed as limited to the embodiments set forth herein; rather, these embodiments are provided so that this disclosure will be thorough and complete, and will fully convey the scope of the invention to those skilled in the art. Among other things, the invention may be embodied as methods, processes, systems, or devices. The following detailed description is, therefore, not to be taken in a limiting sense.

As used herein the following terms have the meanings given below:

Consumer product—refers to any item that may be placed inside of a container and shipped or otherwise made available to a consumer or other person. A consumer product includes inter alia a product that is sold or provided by an entity or person to another entity or person. This may include inter alia items that are sold and shipped for example as a result or an e-commerce transaction; items that are provided as gifts; and items that are ornamental, such as a photo box that displays photos through one or more facets of a container.

Container—refers to a rigid or semi-rigid container, box or package that is used to hold one or more consumer products. As used herein, a container is clear or transparent, or semi-clear or semi-transparent. It may have any 3 dimensional shape including inter alia a cube, a rectangular box, a polyhedron, a sphere, a cylinder, or an irregular shape such as a heart. Typically, a container has sides that are defined by folds or segments. Sides may be square, rectangular, polygonal, circular, or an irregular shape such as a heart. A container may also have a single side, such as in the case of a sphere, in which case there are no folds.

Insert—refers to a sheet that is printed and subsequently cut, folded and inserted into a container. An insert is cut such that when folded each face corresponds to a side of a corresponding container such that when positioned inside the container each insert face is adjacent or next to its corresponding side on the container and the insert fits snugly within the corresponding container. Thus each face on an insert corresponds to a side on the container and is the same size or slightly smaller than the corresponding side. An insert may have fewer faces than the number of sides on the corresponding container. An insert is typically made of paper or cardboard but it is not so limited; it may be made of plastic, vinyl, metal or another printable material. An insert typically includes printed elements such as text and graphics on at least one face that are visible from the outside of the container.

Adjacent—is used to refer to the position of a face of an insert in relation to a corresponding side of a container when the insert is positioned within the container. Generally, it is most preferable for a face of an insert to be in contact with the corresponding face. This enables the insert to maintain its shape by taking advantage of certain material properties, including stiffness, static friction and static cling as discussed hereinbelow. It is also acceptable for a face to be very close to but not touching a corresponding face, such as within 1-2 millimeters.

Transparent and partially transparent—are used interchangeably herein to mean that when a printed insert is fit inside a container such that there are printed elements facing the exterior of the container a person can readily see the printed elements on the insert, such as text or designs, through the container. In some cases, certain sides of a container may be transparent while others may be opaque.

The subject invention is a transparent container with an insert that maintains its form and position when fit snugly inside of the container. The container and insert material are chosen to take advantage of inherent properties including stiffness, static friction and static cling such that no further fastening material, such as glue, adhesive, staples or tape is needed to secure the insert inside the container. In certain embodiments, the insert is die cut and is folded to match the inside shape of the container. Thus, the insert fits nearly exactly, i.e. each face is dimensioned within a few millimeters of its corresponding side on the container. Further, the insert is sufficiently rigid that it maintains its shape and the combination of surface friction and static cling ensures that the insert does not move, bend, fold or otherwise deform when it is fit inside the container. Intended uses include inter alia product packaging, gift wrapping and food packaging.

Figure 1A:
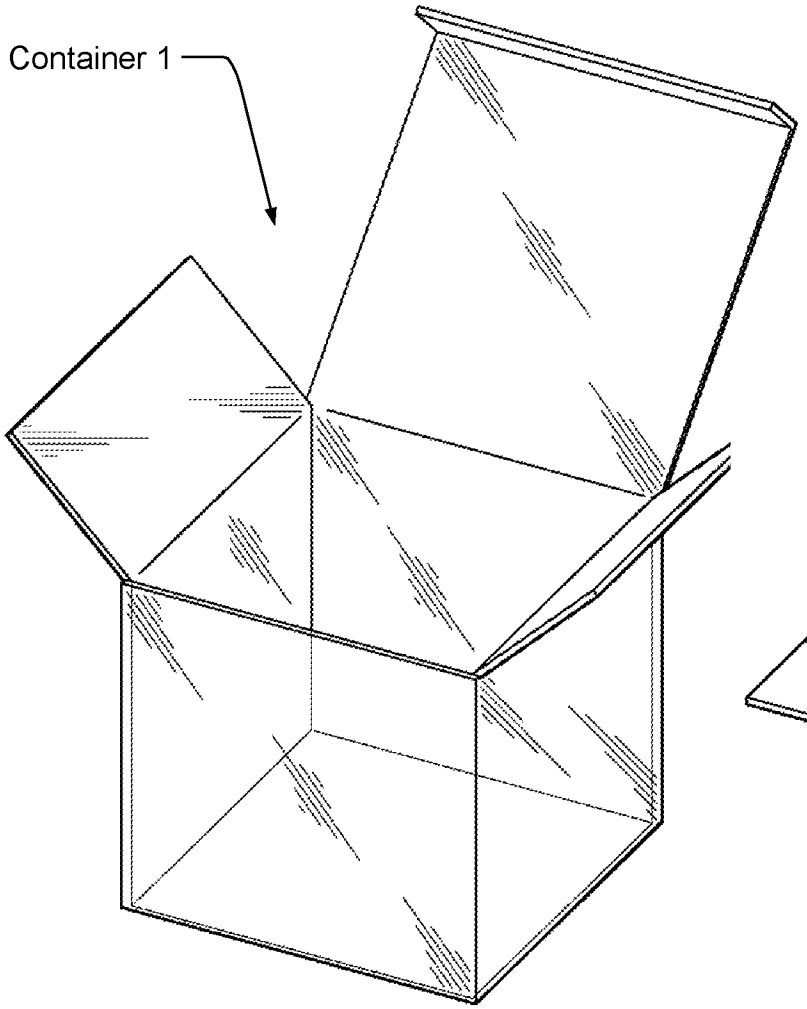
FIG. 1A illustrates a front isometric view of a transparent plastic container.

FIG. 1A illustrates a front isometric view of a transparent, plastic container 1 and a printed insert 2 next to it. In this example, container 1 is a cube with 3 inch sides. Container 1 is a transparent or partially transparent plastic container. It is typically made of PVC or vinyl, PET, or polypropylene and typically has a wall thickness of 0.009 to 0.1 inches. Other types of plastic or other transparent or partially transparent materials can be used and other wall thicknesses are acceptable.

FIG. 1B illustrates a top isometric view of a printed insert 2 that is cut so that it fits snugly within the container 1. Insert 2 is a printable material such as paper, cardboard, fabric, plastic or sheet metal. Insert 2 is typically printed on an inkjet or other commercial printer and then die cut. Each face of insert 2 corresponds nearly exactly to a side of container 1. Insert 2 is typically printed on one side, referred to as an outward facing side, that is visible through the container when the insert is positioned within the container. Faces of insert 2 are typically cut to be the same size or very slightly smaller on each side than the corresponding side of container 1. For example, each face of insert 2 may be 0 to 5 millimeters smaller. For example, if a face of insert 2 is rectangular with a face width and height then a corresponding side of container 1 has a side width and height. Then, either or both of an insert 2 face width and height may be 0 to 5 millimeter smaller than the corresponding side width and height of container 1.

A paper weight for insert 2 is typically selected to both minimize cost and to provide a minimum stiffness so as to not bend or fold. The "Basis Weight" is defined as the weight of 500 sheets of paper in its basic unit uncut size, which means before being cut to Letter size or Legal size, the paper is weighed and categorized. Common weights are denoted as Bond, Text, Book, Cover, Index and Tag. Most standard weights are acceptable for use as insert 2. For example, a paper weight of 20 lb. bond, i.e. standard copy paper, is acceptable. Heavier paper weights including 24 lb. bond, 32 lb. bond and greater are also acceptable.

Figure 2:
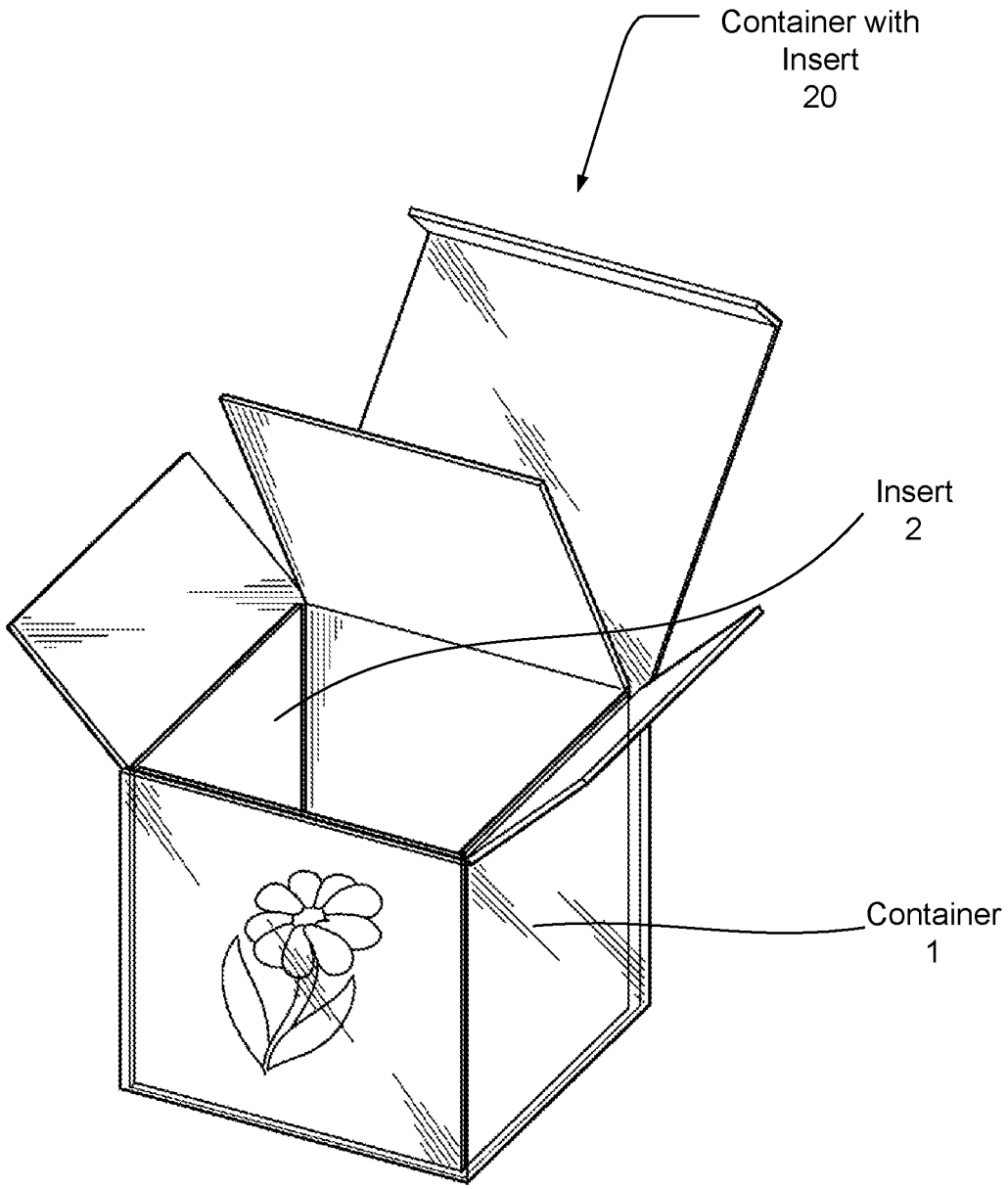
FIG. 2 illustrates a front isometric view of the container of FIG. 1A with the insert of FIG. 1B fitted inside.

FIG. 2 illustrates a front isometric view of the container 1 with insert 2 fitted inside, referred to herein as a container with insert 20. Insert 2 is folded and inserted into container 1 such that the outward facing side faces towards the outside, or exterior of container 1. If a proper material is selected for insert 2 and it is cut to the proper dimensions, it remains rigidly or semi-rigidly in place. No fastening elements or material, such as glue, adhesive, staples or tape are required to hold insert 2 in place within container 1. Therefore, container with insert 20 provides an excellent low-cost packaging solution.

When the dimensions of each face of insert 2 are properly matched with the dimensions of the corresponding sides of container 1, as previously discussed, then insert 2 remains rigidly, or semi-rigidly, secured against the interior of container 1. The degree to which container 1 and insert 2 remain secured or fastened is dependent on several materials choices, including: stiffness, surface friction, and static cling.

Stiffness. Paper and other thin materials have a stiffness that is based on thickness and an inherent factor referred to as elastic modulus. In the case of paper, it is also based on the basis weight of the paper. For commercial packaging a goal is that in normal usage conditions the paper or plastic does not bend, fold or otherwise deform. Thus, after an event that produces tension is a basic requirement that the paper or plastic return to its original form. Generally, a paper weight of 20 lb. bond or greater is satisfactory for insert 2, i.e. the paper does not bend, fold or otherwise deform when it is placed inside container 1; similarly the paper does not bend, fold or otherwise deform during normal usage.

Static friction. Static friction is friction between two or more solid objects that are not moving relative to each other. For example, static friction can prevent an object from sliding down a sloped surface. The coefficient of static friction is a scalar value that expresses the degree to which static friction occurs in different material combinations. For example, diamond-diamond has a low static coefficient of 0.1 while iron-iron has a high static coefficient of 1. Although the static coefficient will vary for each combination of material used for container 1 and insert 2 generally when the preferred materials of plastic (for container 1) and paper (for insert 2) are used a significant amount of static friction will occur.

Static cling. Static cling is the tendency for objects to stick or cling to other objects owing to a buildup of static electricity, i.e. of opposite electrical charges It commonly occurs in certain plastic items, which tend to cling. Another explanation for static cling is a molecular argument which explains that materials with tight molecular bonds such as PVC/polyvinyl and other plastics used in thin plastic sheets are sticky in their own right, regardless of the prescense of static electricity. Whichever argument is used, the close proximity of container 1 and insert 2, when container 1 is made of a suitable plastic material and insert 2 is made of a smooth material such as paper or certain fabrics, will typically result in static cling effect.

Upon reading this disclosure, those of skill in the art will appreciate still additional alternative structural and functional designs through the disclosed principles herein. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the method and apparatus disclosed herein without departing from the spirit and scope defined in the appended claims.

What is claimed is:

1. A device for packaging, comprising:

a container in the shape of a rectangular box that is that is cut and folded from a single sheet of a transparent material into the shape of a rectangular box, the box having six rectangular sides, the six sides including a top and a bottom, wherein each side is formed of a single rectangular section of the sheet of transparent material;

an insert that is cut from a single sheet of a printable material and is folded to create a plurality of rectangular faces, wherein each face is substantially the same rectangular shape as a corresponding side of the container, and wherein the insert is positioned within the container such that each face is adjacent to its corresponding side of the container; and wherein no fastening element is used to secure the insert to the container and the insert is maintained in place within the container at least in part by static cling.

2. The device of claim 1 wherein at least one face of the insert has a printed element on its outward facing side such that the printed element is visible from the exterior of the container.

3. The device of claim 1 wherein the container is made of PVC, vinyl, PET, or polypropylene.

4. The device of claim 1 wherein the container has a thickness of 0.009 to 0.1 inches.

5. The device of claim 1 wherein the insert material is selected from the group consisting of paper, cardboard, fabric, plastic and metal.

6. The device of claim 1 wherein the insert is made of paper with a weight of at least 20 pound (lb.) bond.

7. The device of claim 1 wherein the insert when folded has the same number of faces as the container.

8. The device of claim 1 wherein the insert when folded has less faces than the container.

9. The device of claim 1 wherein the insert, when folded, has six sides.

* * * * *